US009470373B2

(12) United States Patent
Hiller

(10) Patent No.: US 9,470,373 B2
(45) Date of Patent: Oct. 18, 2016

(54) LED LAMP

(71) Applicant: Cree, Inc., Durham, NC (US)

(72) Inventor: Norbert Walter Georg Hiller, Chapel Hill, NC (US)

(73) Assignee: Cree, Inc., Durham, NC (US)

( * ) Notice: Subject to any disclaimer, the term of this patent is extended or adjusted under 35 U.S.C. 154(b) by 162 days.

(21) Appl. No.: 14/045,149

(22) Filed: Oct. 3, 2013

(65) Prior Publication Data

US 2015/0098238 A1 Apr. 9, 2015

(51) Int. Cl.

| | |
|---|---|
| ***H01R 33/00*** | (2006.01) |
| ***F21K 99/00*** | (2016.01) |
| ***G09F 13/06*** | (2006.01) |
| ***G09F 23/00*** | (2006.01) |

(52) U.S. Cl.

CPC ..... *F21K 9/135* (2013.01); *F21K 9/1355* (2013.01); *G09F 13/06* (2013.01); *G09F 23/00* (2013.01); *F21K 9/52* (2013.01)

(58) Field of Classification Search

CPC ..... F21K 9/13; F21K 9/135; F21K 9/1355; G09F 13/06; G09F 23/00

See application file for complete search history.

(56) References Cited

U.S. PATENT DOCUMENTS

| | | | | |
|---|---|---|---|---|
| 5,900,678 | A * | 5/1999 | Rodgers | 307/10.1 |
| 6,550,952 | B1 * | 4/2003 | Hulse et al. | 362/555 |
| 6,761,468 | B1 * | 7/2004 | Bogal | 362/208 |
| 7,213,940 | B1 | 5/2007 | Van De Ven et al. | |
| 7,448,769 | B1 * | 11/2008 | Coushaine | F21L 4/005 362/200 |
| 2004/0264187 | A1 * | 12/2004 | Vanderschuit | 362/235 |
| 2005/0083676 | A1 * | 4/2005 | VanderSchuit | 362/84 |
| 2011/0298355 | A1 * | 12/2011 | van de Ven | 313/483 |
| 2011/0298371 | A1 * | 12/2011 | Brandes et al. | 315/32 |
| 2012/0169204 | A1 * | 7/2012 | Wu | F21K 9/135 313/116 |
| 2013/0335966 | A1 * | 12/2013 | Yokota et al. | 362/235 |
| 2014/0119007 | A1 * | 5/2014 | Edmond et al. | 362/235 |

* cited by examiner

*Primary Examiner* — Peggy Neils
*Assistant Examiner* — Alexander Garlen
(74) *Attorney, Agent, or Firm* — Dennis J. Williamson; Moore & Van Allen PLLC

(57) ABSTRACT

A lamp comprises has an optically transmissive enclosure and a base. At least one LED is located in the enclosure and is operable to emit light when energized through an electrical path from the base. A light non-transmissive portion defines a light transmissive portion where the light transmissive portion is illuminated when the at least one LED is energized. The light transmissive portion may define information such as branding information.

21 Claims, 15 Drawing Sheets

LED LAMP

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs (OLEDs), which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an envelope or enclosure for the electronics and or the LEDs in the lamp.

Since, ideally, an LED lamp designed as a replacement for a traditional incandescent or fluorescent light source needs to be self-contained; a power supply may be included in the lamp structure along with the LEDs or LED packages and the optical components. A heatsink is also often needed to cool the LEDs and/or power supply in order to maintain appropriate operating temperature.

SUMMARY OF THE INVENTION

In some embodiments a lamp comprises an optically transmissive enclosure and a base. At least one LED is located in the enclosure and is operable to emit light when energized through an electrical path from the base. A light non-transmissive portion defines a light transmissive portion where the light transmissive portion is illuminated when the at least one LED is energized.

The light non-transmissive portion may form part of the base. The light non-transmissive portion may form part of the enclosure. The light transmissive portion may comprise indicia. The indicia may comprise branding information. The light transmissive portion may be formed as a thin walled section of the base. The light transmissive portion may be formed as a thin walled section of the enclosure. The light transmissive portion may comprise a lens. The lens may comprise at least one of a transparent, semi-transparent or translucent material. The lens may be insert molded in the non-transmissive portion. The light transmissive portion may comprise an aperture. The light from the LEDs in the enclosure may illuminate the light transmissive portion. An additional LED separate from the LEDs in the enclosure may illuminate the light transmissive portion. The additional LED may be positioned in the enclosure adjacent the base. A light guide may transmit light from the additional LED to the light transmissive portion. The light guide may transmit light from the LEDs in the enclosure to the light transmissive portion. The light guide may extend from the enclosure into the base. The light guide may extend through a heat sink. A reflector may be provided for reflecting light toward the light transmissive portion. The light non-transmissive portion may be formed by a coating on the enclosure and the light transmissive portion may be formed by a gap in the coating.

DETAILED DESCRIPTION

Figure 1:
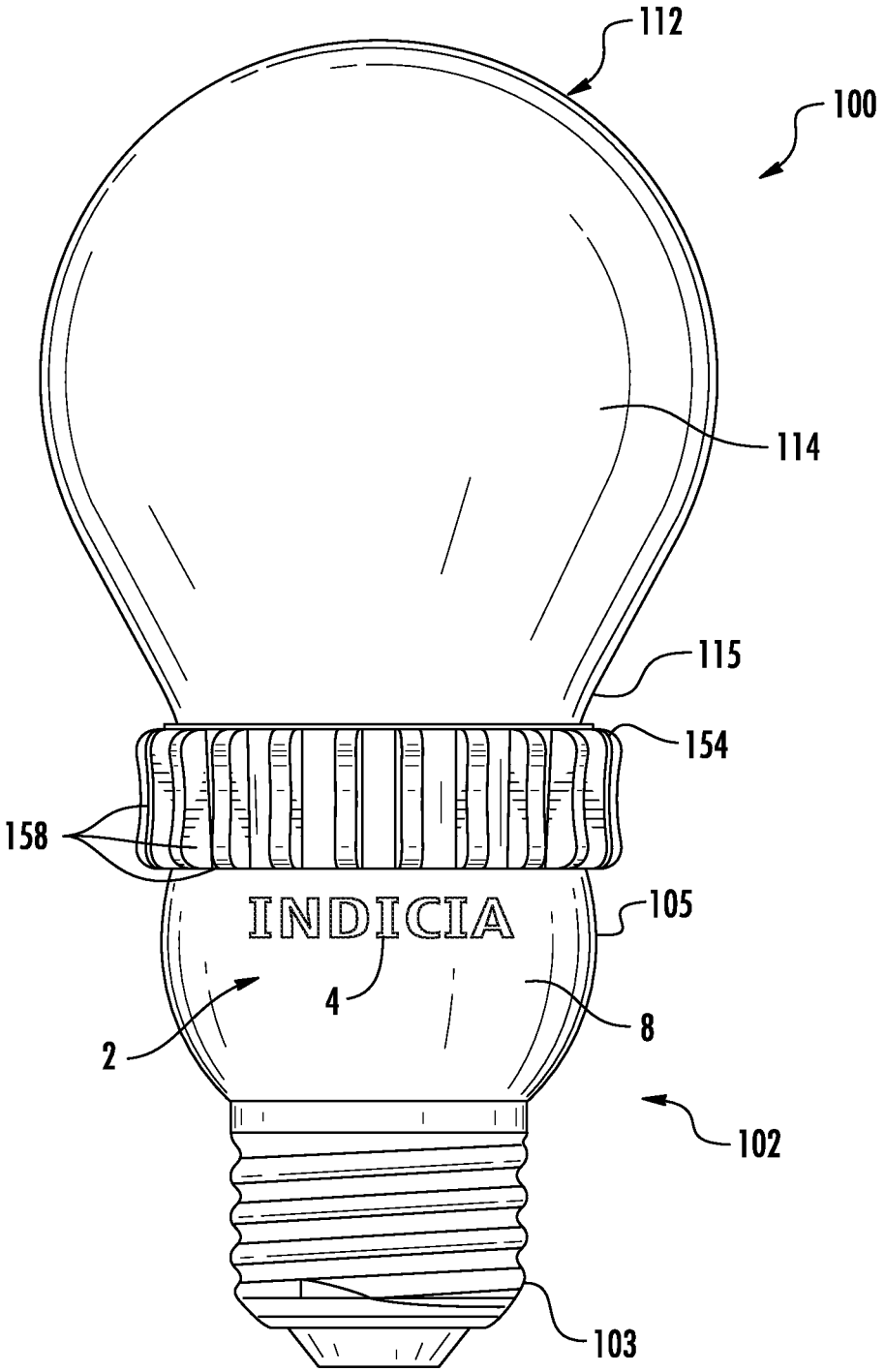
FIG. 1 is a front view of an embodiment of a lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Multiple LEDs can be used together, forming an LED array. The LEDs can be mounted on or fixed within the lamp in various ways. In at least some example embodiments, a submount is used. The LEDs may be disposed at or near the central portion of the structural envelope of the lamp. The term "lamp" is meant to encompass not only a solid-state replacement for a traditional incandescent and fluorescent bulbs as illustrated herein, but also complete light fixtures.

Figure 2:
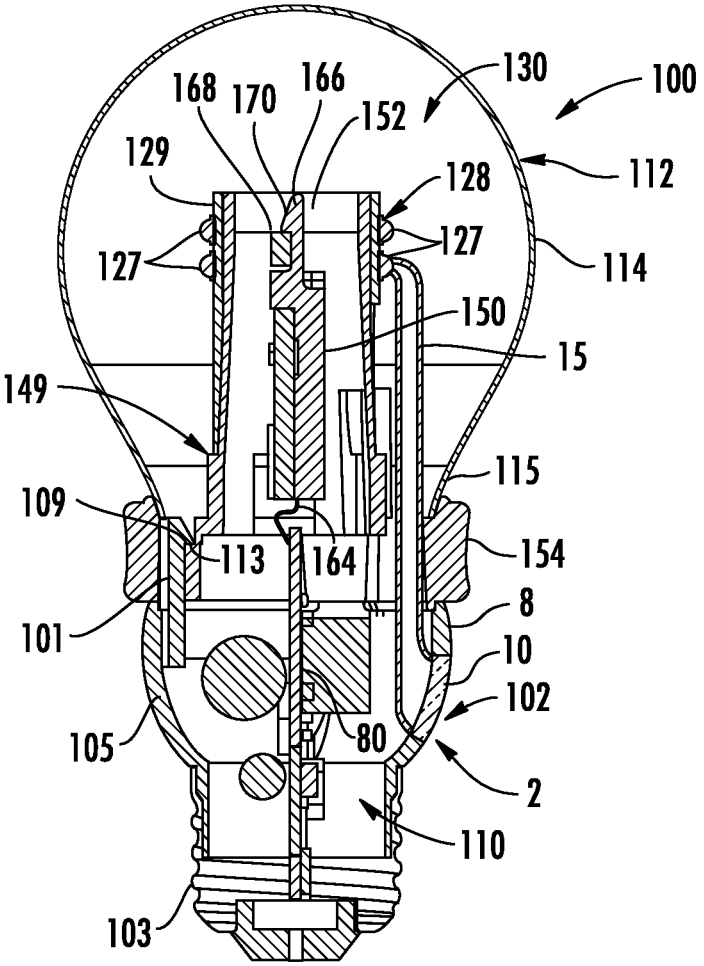
FIG. 2 is a section view of the lamp of FIG. 1.

FIGS. 1 and 2 show a lamp 100 according to some embodiments of the present invention. Lamp 100 may be used as an A-series lamp with an Edison base 102, more particularly; lamp 100 is designed to serve as a solid-state replacement for an A19 incandescent bulb. The Edison base 102 as shown and described herein may be implemented through the use of an Edison connector 103 and a plastic form 105.

The LEDs 127 in the LED array 128 may comprise an LED die disposed in an encapsulant such as silicone, and LEDs which are encapsulated with a phosphor to provide local wavelength conversion, as will be described later when various options for creating white light are discussed. A wide variety of LEDs and combinations of LEDs may be used in the LED assembly 130 as described herein. The LEDs 127 can be mounted on or fixed within the lamp in various ways. In at least some example embodiments, the LEDs are mounted on submount 129 and are operable to emit light when energized through an electrical connection. Multiple LEDs 127 can be used together, forming LED array 128. In the present invention the term "submount" is used to refer to the support structure that supports the individual LEDs or LED packages.

An optically transmissive enclosure 112 is mounted to the base 102 for emitting light. In some embodiments the enclosure 112 may be made of glass, quartz, borosilicate, silicate, polycarbonate, other plastic or other suitable material. The enclosure 112 may be of similar shape to that commonly used in household incandescent bulbs. In some embodiments, the glass enclosure is coated on the inside with silica, providing a diffuse scattering layer that produces a more uniform far field pattern. The enclosure 112 may also be etched, frosted or coated. Alternatively, the surface treatment may be omitted and a clear enclosure may be provided. The enclosure 112 may also be provided with a shatter proof or shatter resistant coating. It should also be noted that in this or any of the embodiments shown here, the optically transmissive enclosure 112 or a portion of the optically transmissive enclosure 112 could be coated or impregnated with phosphor or a diffuser. The enclosure 112 may have a traditional bulb shape having a globe shaped main body 114 that tapers to a narrower neck 115. The enclosure emits light from the lamp for illumination purposes when the LEDs are energized.

In some embodiments, the submount 129 may comprise a printed circuit board ("PCB"), metal core board, metal core printed circuit board, a lead frame, a hybrid combination of metal core board/lead frame submount, a PCB made with FR4/lead frame submount, an extruded submount, or other similar structure. The submount may be made of a thermally conductive material. The submount 129 may be bent into the configuration of the LED assembly 130 as shown in the figures. An electrical path runs between the submount 129 and the lamp base 102 to carry both sides of the supply to provide critical current to the LEDs 127. The submount 129 may be bent or folded such that the LEDs 127 provide the desired light pattern in lamp 100. In one embodiment the submount 129 is bent into a cylindrical shape. The LEDs 127 are disposed about the axis of the cylinder such that light is projected outward. In a lead frame configuration, the lead frame may be bent at the connectors and in a metal core board configuration the core board may be bent at thinned score lines to form the three-dimensional LED assembly 130. The LEDs 127 may be arranged around the perimeter of the LED assembly 130 to project light radially.

Because the submount 129 is pliable and the LED placement on the substrate may be varied, the submount may be formed and bent into a variety of configurations. For example one of the LEDs 127 may be angled toward the bottom of the LED assembly 130 and another of the LEDs 127 may be angled toward the top of the LED assembly 130 with the remaining LEDs projecting light laterally from a cylindrical LED assembly 130. The angles of the LEDs and the number of LEDs may be varied to create a desired light pattern. For example, the figures show an embodiment of a two tiered LED assembly 130 where each tier comprises a series of a plurality of LEDs 127 arranged around the perimeter of the cylinder. While a two tiered LED assembly is shown the LED assembly may comprise one tier, three tiers or additional tiers of LEDs where each tier comprises a series of a plurality of LEDs 127 arranged around the perimeter of the cylinder. The LED assembly 130 may be formed to have any suitable three-dimensional geometric shape.

In some embodiments, a driver and/or power supply are included with the LED array 128 on the submount 129. In other embodiments the driver and/or power supply 110 are included in the base 102 as shown. The power supply and drivers may also be mounted separately where components of the power supply are mounted in the base 102 and the driver is mounted with the submount 129 in the enclosure 112. Base 102 may include a power supply and/or driver 110 that may be mounted on a board 80 and form all or a portion of the electrical path between the mains and the LEDs 127.

In one embodiment, the enclosure and base are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. While a lamp having the size and form factor of a standard-sized household incandescent bulb is shown, the lamp may have other sizes and form factors. For example, the lamp may be a PAR-style lamp such as a replacement for a PAR-38 incandescent bulb or a BR-style incandescent bulb. In other embodiments, the LED lamp can have any shape, including standard and non-standard shapes.

LEDs and/or LED packages used with embodiments of the invention can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. In one example embodiment, the LED devices include a group of LEDs, wherein each LED, if and when illuminated, emits light having dominant wavelength from 440 to 480 nm. The LED devices include another group of LEDs, wherein each LED, if and when illuminated, emits light having a dominant wavelength from 605 to 630 nm. A phosphor can be used that, when excited, emits light having a dominant wavelength from 560 to 580 nm, so as to form a blue-shifted-yellow light with light from the former LED devices. In another example embodiment, one group of LEDs emits light having a dominant wavelength of from 435 to 490 nm and the other group emits light having a dominant wavelength of from 600 to 640 nm. The phosphor, when excited, emits light having a dominant wavelength of from 540 to 585 nm. A further detailed example of using groups of LEDs emitting light of different wavelengths to produce substantially while light can be found in issued U.S. Pat. No. 7,213,940, which is incorporated herein by reference.

A heat sink 149 may be provided for dissipating heat from the LEDs 127. The heat sink 149 may comprise a heat conducting portion 152 that is thermally coupled with the LED assembly 130 such that heat is conducted away from the LED assembly 130 by the heat conducting portion 152. The heat conducting portion 152 is thermally coupled to a heat dissipating portion 154 that extends to the exterior of the lamp and that dissipates heat from the lamp 100. In one embodiment the heat conducting portion 152 and heat dissipating portion 154 are formed as one-piece. The heat dissipating portion 154 extends from the interior of the enclosure 112 to the exterior of the lamp 100 such that heat may be dissipated from the lamp to the ambient environment. In one embodiment the heat dissipating portion 154 extends outside of the lamp and forms an annular ring that sits on top of the open end of the base 102. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

An electrical interconnect 150 may be provided for physically connecting the heat sink 149 to the base and for electrically connecting the LED assembly to the base electronics. The electrical interconnect may comprise a first pair of conductors 164 for connecting to the lamp electronics 110 and a second pair of conductors (not shown) for connecting to the LED assembly 130. The electrical interconnect 150 may be connected to the heat sink 149 using a snap-fit connector such as a flexible finger 166 having a locking member 170 that engages a member 168 formed on the heat sink 149. A similar snap-fit connector comprising one or more arms 101 on base 102 having a locking member 109 engage members 113 on the heat sink 149 to connect the base 102 to the heat sink.

A lamp base 102 such as an Edison base functions as the electrical connector to connect the lamp 100 to an electrical socket or other connector. Depending on the embodiment, other base configurations are possible to make the electrical connection such as other standard bases or non-traditional bases. The base 102 comprises an electrically conductive Edison screw 103 for connecting to an Edison socket and a housing portion 105 connected to the Edison screw. The Edison screw 103 may be connected to the housing portion 105 by adhesive, mechanical connector, welding, separate fasteners or the like. The housing portion 105 may comprise an electrically insulating material such as plastic. Further, the material of the housing portion 105 may comprise a thermally conductive material such that the housing portion 105 may form part of the heat sink structure for dissipating heat from the lamp 100. The housing portion 105 and the Edison screw 103 define an internal cavity for receiving the electronics 110 of the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

The base 102 is made such that it is generally light non-transmissive. For example, the Edison screw is typically made of steel or other conductive metal and the housing 105 may be made of a plastic in a thickness such that it is light non-transmissive. "Light non-transmissive" as used herein means that visible light cannot pass through a material or structure while "light transmissive" means that visible light may pass through a material or structure such that the material or structure appears as an illuminated or lit area. The base 102 is provided with a light transmissive portion 2 that allows visible light to be transmitted from the interior of the lamp to the exterior of the lamp through the base 102. The light transmissive portion 2 may be formed in a light non-transmissive portion 8 such that the light transmissive portion 2 visually appears as an illuminated area of an otherwise non-illuminated portion 8. The light transmissive portion 2 may comprise a light transmissive window or windows that may be lit or illuminated from the inside of the lamp such that the light transmissive portion 2 appears as an illuminated or lighted portion of the lamp base 102 when visually compared to the light non-transmissive portion 8 that comprises the remainder of the base 102. The light transmissive portion is not used for illumination. The light emitted from or illuminating the light transmissive portion is used to illuminate the light transmissive portion for conveying information or the like rather than for projecting light from the lamp that may be used for illumination purposes.

In one embodiment the light transmissive portion 2 may be used to convey information to the user and is not necessarily used to increase or otherwise affect the light output from the optically transmissive enclosure 112. For example, the light transmissive portion 2 may comprise markings, words, indicia 4 such as a logo, trademark, trade name, trade symbol or the like that is used to convey branding information to the user. In other embodiments, the markings, words, indicia 4 may be used to convey other information to the user such as information about the lamp 100 such as wattage equivalent, color or the like. The markings, words, indicia 4 may be used to convey any type of information. In some embodiments, the markings, words, indicia may be decorative but not necessarily informative. More than one light transmissive portion 2 may be formed in the light non-transmissive portion 8.

Figure 3:
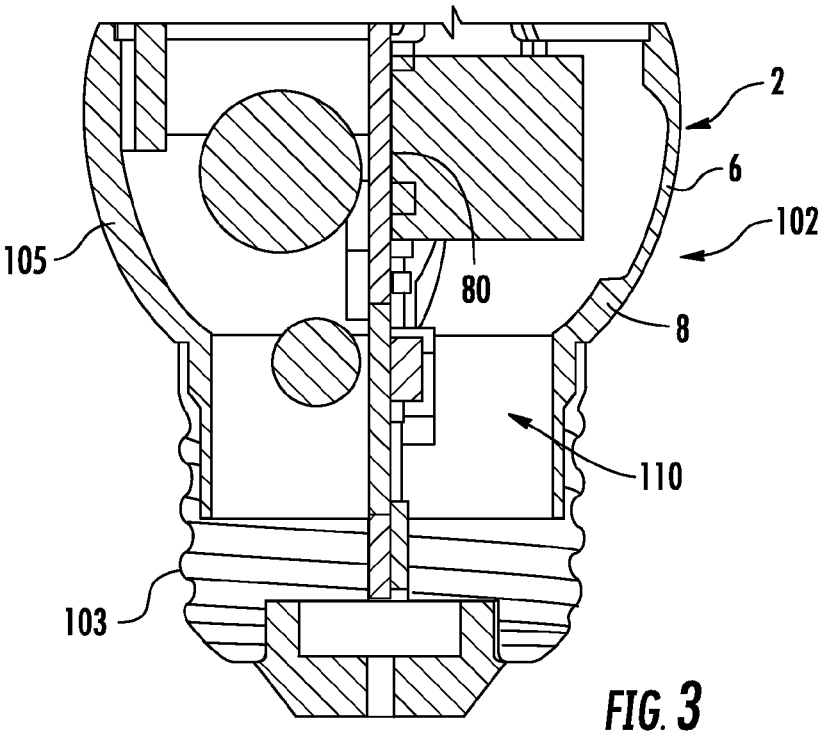
FIGS. 3 through 6 are detailed section views showing alternate embodiments of the lamp.

In some embodiments, the light transmissive portion 2 may be formed as a thin walled section of the housing 105. For example, referring to FIG. 3, the housing 105 may be formed of plastic or other material in an overall thickness that is opaque and that prevents transmission of light. The light transmissive portion 2 may be formed as a thin walled area 6 that allows light to be transmitted through the light transmissive portion 2 such that the light transmissive portion 2 appears as an illuminated or lighted area. The thickness of the thin walled area 6 is selected such that from the exterior of the lamp the thin walled area 6 appears as a lighted or illuminated area compared to the thick walled portion 8 of the base 102.

Figure 4:
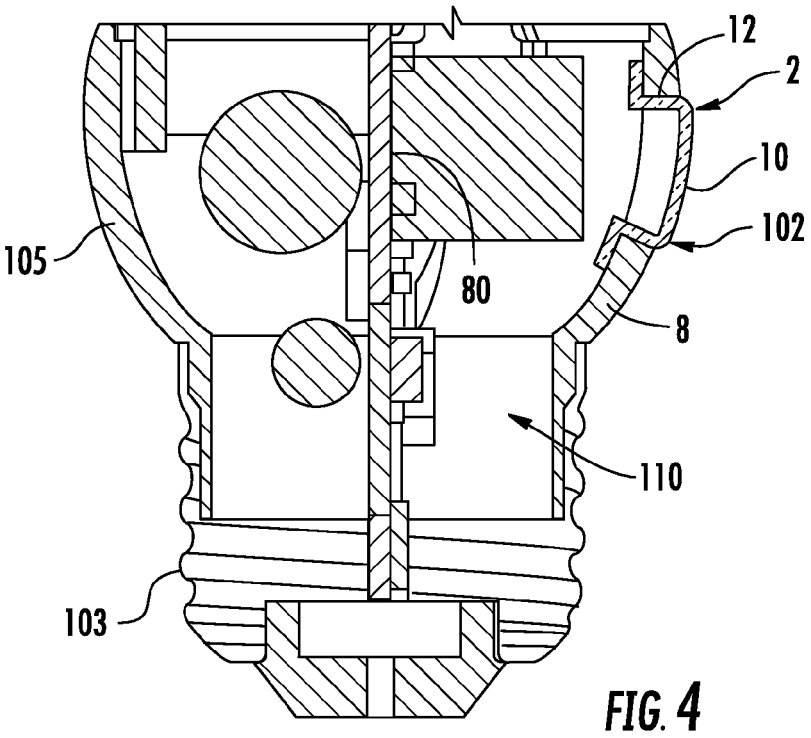
Figure 5:
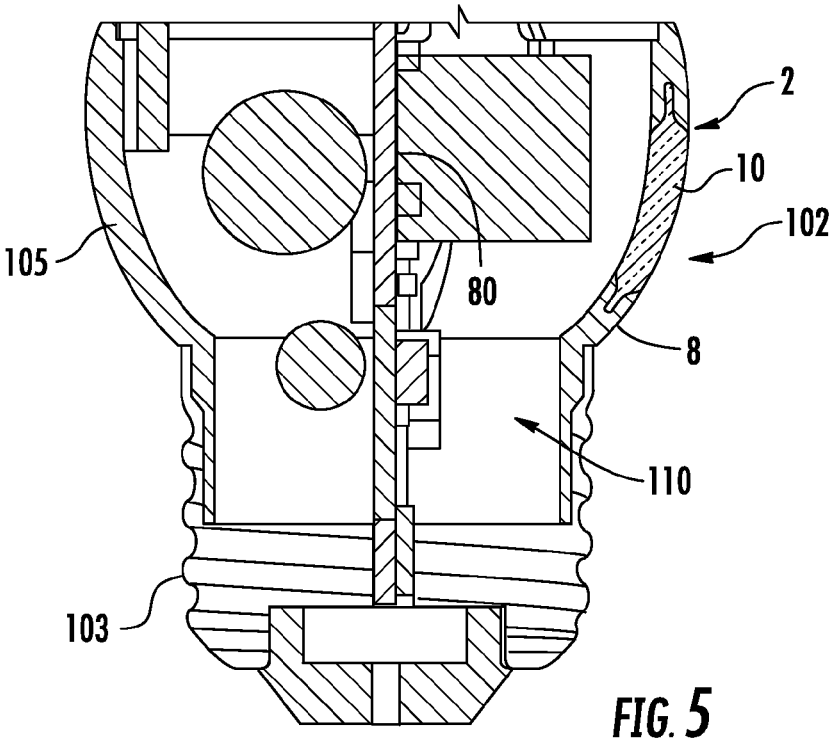
Figure 6:
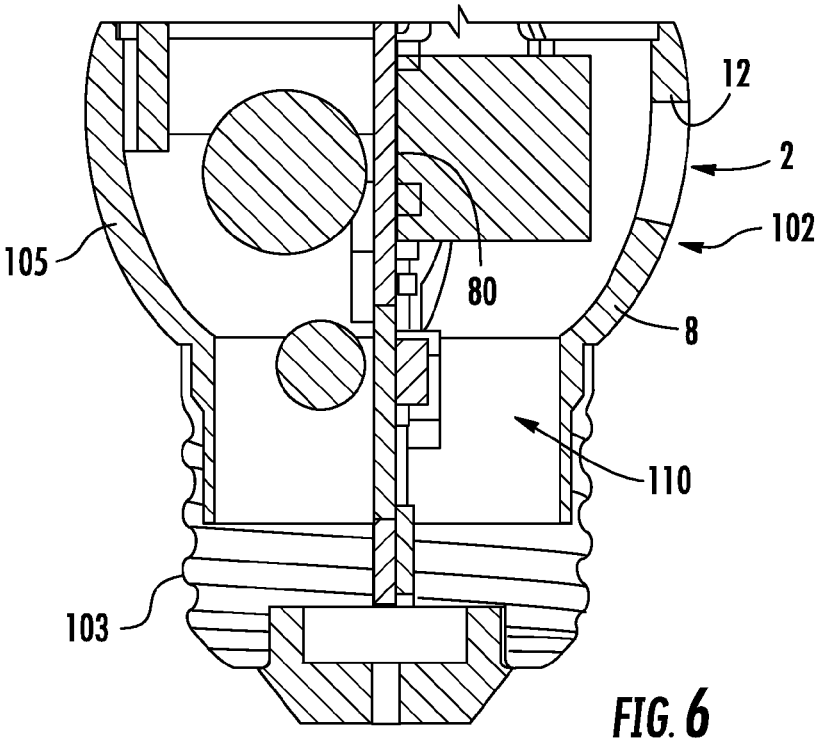

In other embodiments, the light transmissive portion 2 may be formed of a different material than the light non-transmissive portion 8. For example, as shown in FIGS. 2 and 4, the light transmissive portion 2 may be formed as a lens 10 made of a transparent, semi-transparent or translucent material such as glass or plastic where the light transmissive material is different than the opaque material that forms the light non-transmissive portion 8 of the base. The materials of the light transmissive portion 2 and the light non-transmissive portion 8 are selected such that the light transmissive portion 2 transmits light through the base in a manner that creates a visible illuminated effect for the user. The light transmissive portion 2 may be defined by an aperture or apertures 12 formed through the base 102 where the aperture or apertures 12 are covered by the lens 10 that is mounted on or to the base 102. The lens 10 may be secured the base by any suitable mechanism such as adhesive, mechanical connector, snap-fit connector, friction fit, welding or the like. In some embodiments the lens 10 may be insert molded in the base 102 such that the base 102 and the lens 10 form a unitary assembly as shown in FIG. 5. In other embodiments, the aperture or apertures 12 may be left open as shown in FIG. 6.

The lens 10 may be formed of a colored material or the thinned portion 6 may be painted or otherwise colored such that the light transmitted from the light transmissive portion 2 is a different color than the light emitted from the enclosure 112. For example, where the enclosure 112 emits white light the light transmissive portion 2 may include a colored lens 10, for example, to emit light of a different color. In some embodiments, the color of the emitted light from light transmissive portion 2 may be selected to coordinate with the information transmitted by the indicia 4. For example, where the indicia 4 is branding information such as a trademark, trade name, trade symbol or the like the light may be emitted in a color that is associated with or forms part of the brand.

Light used to illuminate the light transmissive portion 2 may be light generated by the LED assembly 128 and/or the light may comprise light emitted from an LED used specifically to illuminate the light transmissive portion 2. In one embodiment, as shown in FIG. 2, a portion of the light generated by the LED assembly 128 may be used to light the light transmissive portion 2. For example, a light tube or light pipe (hereinafter "light guide") 14 may be arranged that extends from adjacent the LED assembly 128 into the base 102 where the light is directed to the light transmissive portion 2. The light guide 14 may comprise fiber optics such as one or more glass or plastic fiber optic tubes or it may comprise a tube or pipe lined with a highly reflective material or it may comprise a solid material such as polycarbonate. The light guide may be rigid or flexible. One end of the light guide 14 is positioned adjacent the LED assembly 128 to receive a portion of the light generated by the LEDs 127 and the opposite end of the light guide 14 is disposed adjacent the light transmissive portion 2 to direct the transmitted light toward the light transmissive portion 2. The light guide 14 may extend from the LED assembly 128 through the optically transmissive enclosure 112 and into the base 102. In one embodiment the light guide 14 extends through the heat sink 149.

Figure 7:
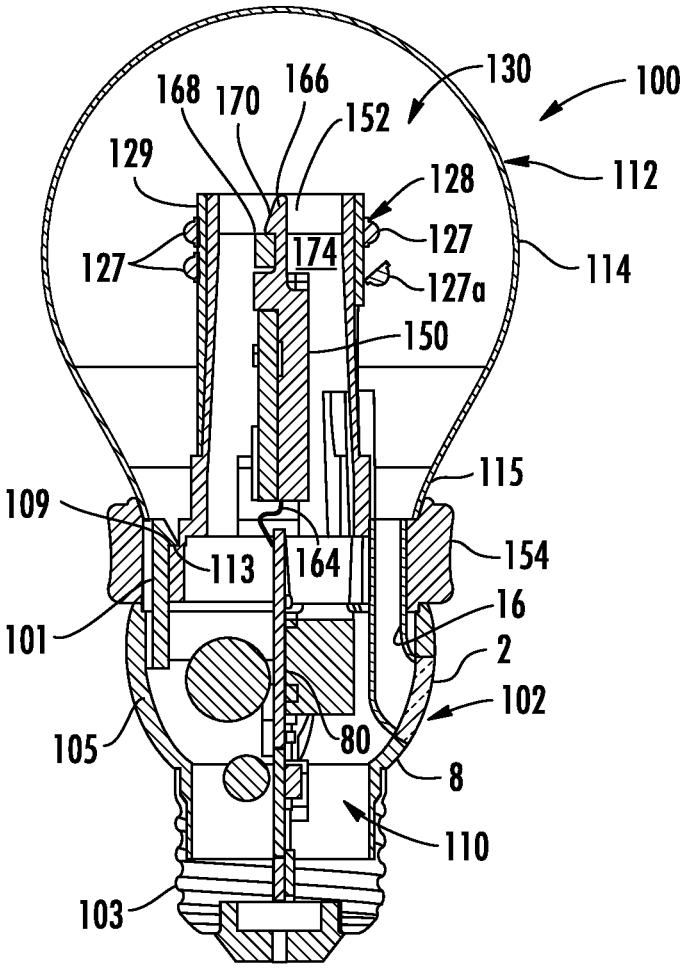
FIGS. 7 through 11 are section views similar to FIG. 2 showing alternate embodiments of the lamp.

Referring to FIG. 7, in other embodiments, a light guide 16 may be provided in the base 103 that gathers light from the interior of the enclosure 112 and transmits the light toward the light transmissive portion 2. In such an embodiment, the light guide 16 does not extend to the LED assembly 128 and instead terminates adjacent base 102 and gathers light directed in the general direction of the base 102 and transmits a portion of the light toward the light transmissive portion 2. As previously explained, one or more of the LEDs 127*a* in array 128 may be disposed such that it faces towards the base 102 such that the light from LED 127*a* is projected primarily toward the base and toward the light guide 16.

Figure 8:
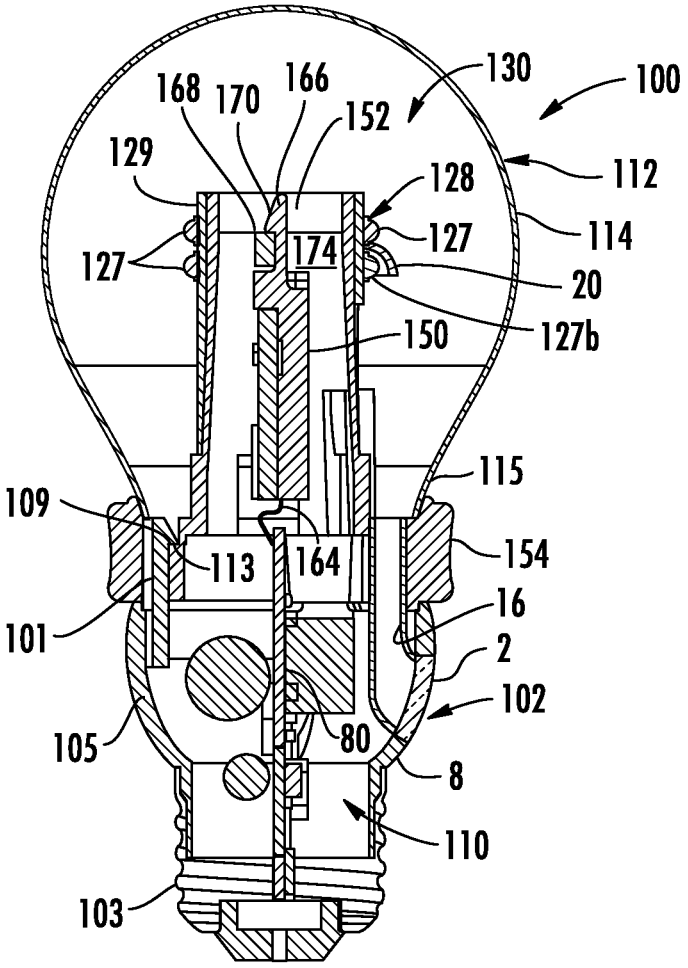

In other embodiments, a reflector 20 may be positioned adjacent an LED 127*b* such as an LED that forms part of the LED assembly 128 to direct some of the light emitted by the LED assembly toward the light guide 16 as shown in FIG. 8. The reflector 20 may, for example, be conical, parabolic, hemispherical, faceted or the like. In some embodiments, the reflector may be a diffuse or Lambertian reflector and may be made of a white highly reflective material such as injection molded plastic, white optics, PET, MCPET, or other reflective materials. The reflector may reflect light but also allow some light to pass through it. The reflector 20 may be made of a specular material. The specular reflectors may be injection molded plastic or die cast metal (aluminum, zinc, magnesium) with a specular coating or material.

Figure 9:
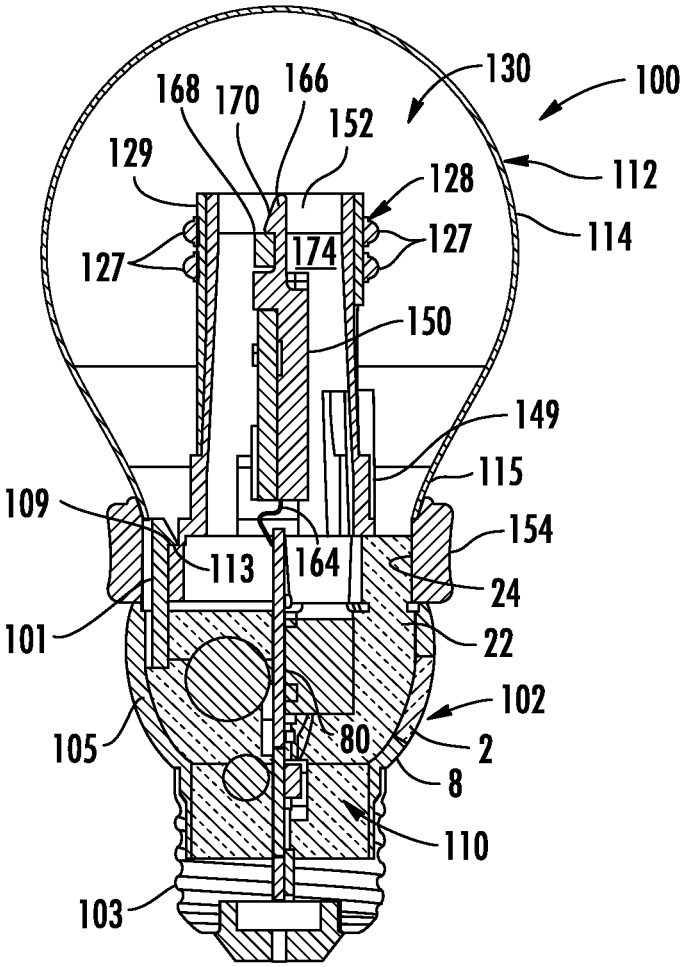

Because the base may be potted as previously described the light guide may extend through the potting material such that the light is transmitted through the potting material to the light transmissive portion 2. In other embodiments the potting material 22 may be made transparent or semi-transparent such that the potting material 22 forms part, or all, of the light path from the LEDs to the transmissive portion 2. In the embodiment of FIG. 9 the potting material 22 extends to the enclosure 112 through an aperture 24 formed in the heat sink 149 such that the light may be transmitted from the enclosure 112 through the potting material 22 to the light transmissive portion 2.

Figure 10:
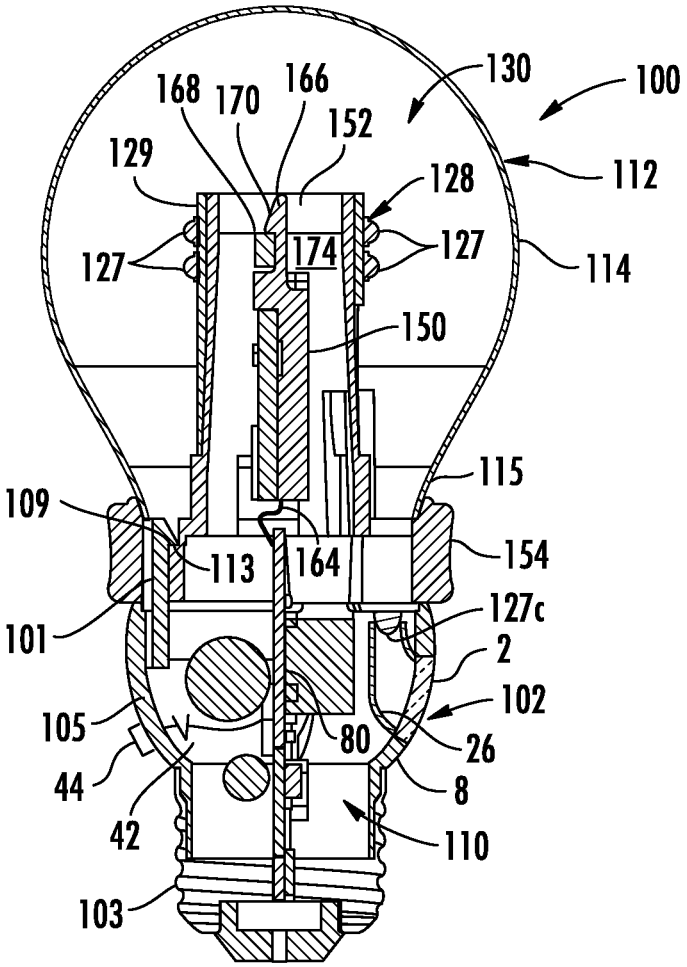
Figure 11:
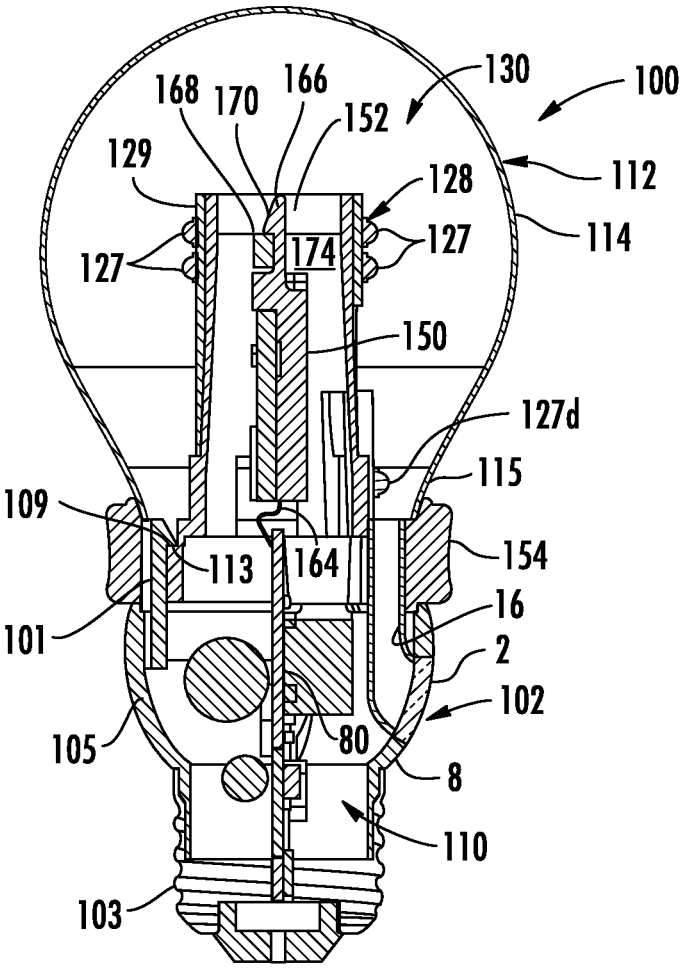

In another embodiment, an LED may be provided specifically for illuminating the light transmissive portion 2 as shown in FIG. 10. The LED 127*c* may be disposed in the base 102 directly opposite or adjacent to the light transmissive portion 2 such that light from the LED 127*c* is used primarily or exclusively to illuminate the light transmissive portion 2 and does not form part of the LED assembly 128. LED 127*c* is electrically connected to the electrical path between the lamp electronics and the LED assembly via suitable conductors such that LED 127*c* is energized to emit light when the LED assembly 128 is energized. A switch 42 may be provided for interrupting current to the LED 127*c* such that the light transmissive portion 2 may be turned off while allowing the LED assembly 128 to operate. The switch 42 may be operated by a manually actuated button or other actuator 44. A light guide 26 may be provided for transmitting light from LED 127*c* to the light transmissive portion 2. However, because of the proximity of the LED 127*c* to the light transmissive portion 2 the light guide may be eliminated. In other embodiments, as shown in FIG. 11, a LED 127*d* may be disposed in the enclosure 112 adjacent the base 103 such that a portion of the light from the LED 127*d* is directed to the light transmissive portion 2 and other light from the LED 127*d* is directed into the enclosure 112 to be used as light emitted from enclosure 112. A light guide 16 may be used to transmit the light to the light transmissive portion 2.

Figure 12:
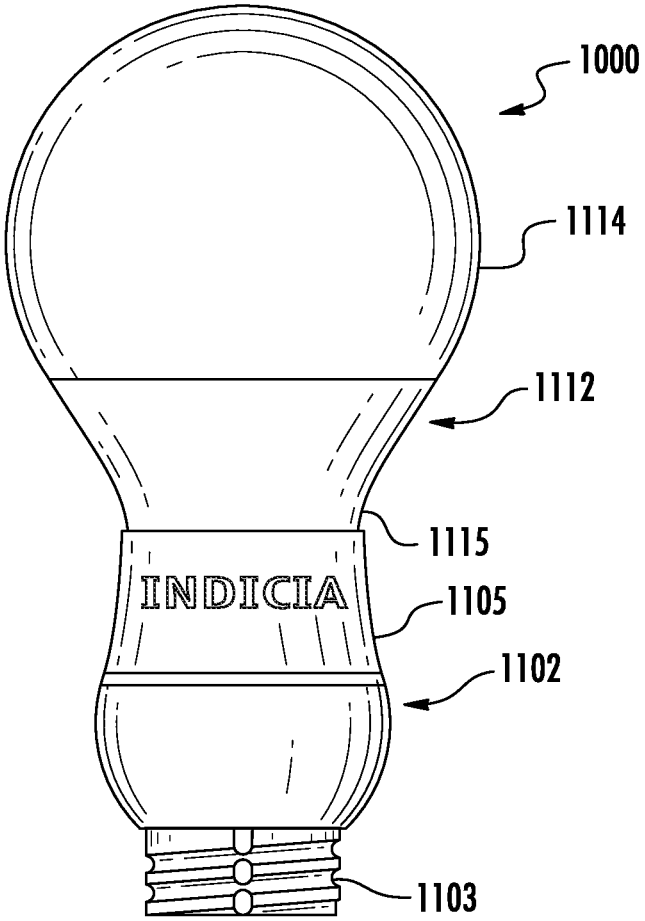
FIG. 12 is a front view of another embodiment of a lamp of the invention.
Figure 13:
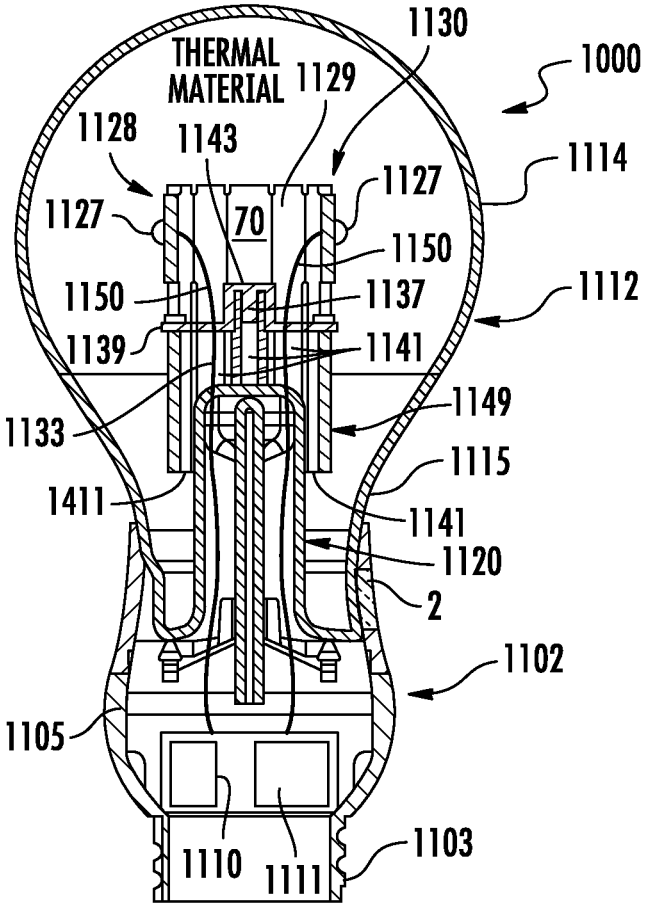
FIG. 13 is a section view of the lamp of FIG. 12.

In another embodiment of a lamp, shown in FIGS. 12 and 13, the lamp 1000 comprises a solid-state lamp comprising a LED assembly 1130 with light emitting LEDs 1127. Multiple LEDs 1127 can be used together, forming an LED array 1128. The LEDs 1127 can be mounted on or fixed within the lamp in various ways. In at least some example embodiments, a submount 1129 is used. A wide variety of LEDs and combinations of LEDs may be used in the LED assembly 1130 as described herein. The LEDs 1127 of the LED array 1128 of lamp 1000 may be mounted on multiple sides of submount 1129 and are operable to emit light when energized through an electrical connection. Wires 1150 run between the submount 1129 and the lamp base 1102 to carry both sides of the supply to provide critical current to the LEDs 1127. The wires 1150 may be used to both supply current to the LEDs and to physically support the LEDs on the stem 1120.

In some embodiments, a driver and/or power supply may be included with the LED array on the submount 1129. In other embodiments the driver 1110 and/or power supply 1111 are included in the base 1102 as shown in FIG. 13. The power supply 1111 and/or drivers 1110 may also be mounted separately where components of the power supply 1111 are mounted in the base 1102 and the driver 1110 is mounted with the submount 1129 in the enclosure 1112. Base 1102 may include a power supply 1111 or driver 1110 and form all or a portion of the electrical path between the mains and the LEDs 1127. The base 1102 may also include only part of the power supply circuitry while some smaller components reside on the submount 1129.

The LED assembly 1130 also may be physically supported by a stem 1120. A tube 1133 extends beyond the end of the hollow stem 1120. In one embodiment the tube 1133 and stem 1120 are formed of glass and may be formed as a one-piece member. The tube 1133 that receives a post 1137 formed on a support 1143. Support 1143 further comprises a plurality of radially extending arms 1139 that are supported by the post 1137. The arms 1139 engage the LED assembly 1130 to support the LED assembly on stem 1120. In one embodiment the arms 1139 are inserted between fins 1141 formed on LED assembly 1130 such that the LED assembly is constrained from movement. The wires 1150 may be used to maintain the LED assembly 1130 in position on the support 1143 and to maintain the support 1143 in tube 1133. The LED assembly 1130 may also be supported by separate support wires that are fused into the glass stem 1120 and are connected to the LED assembly. Further, if wires 1150 adequately support the LED assembly 1130, the support 1143 and/or additional support wires may be eliminated.

The centralized LED array 1128 and any co-located power supply and/or drivers for lamp 1000 may be adequately cooled by helium gas, hydrogen gas, and/or another thermal material which fills the optically transmissive enclosure 1112 and provides thermal coupling to the LEDs 1127. The thermal material may comprise a combination of gasses such as helium and oxygen, or helium and air, or helium and hydrogen, or helium and neon or other combination of gases. In a preferred embodiment the thermal conductivity of the combined gases is at least about 60 mW/m-K. The helium, hydrogen or other gas may be under pressure, for example the pressure of the helium or other gas may be about 0.5 to 10 atmospheres. Because the gas adequately cools the LEDs, the lamp 1000 may use a traditional glass stem 1120 to support the LED assembly 1130.

To facilitate the cooling of the LEDs 1127, the LEDs may be mounted on a thermally conductive submount 1129 that improves and increases the heat transfer between the thermal gas contained in enclosure 1112 and the LEDs 1127. The submount 1129 may comprise heat sink structure 1149 comprising a plurality of fins or other similar structure 1141 that increases the surface area of contact between the heat sink and the thermal gas in enclosure 1112. In some embodiments a gas movement device such as a fan may be provided to move the thermal gas within the enclosure 1112 to increase the heat transfer between the LEDs 1127, LED array 1128, submount 1129, and/or heat sink 1149 of LED assembly 1130 and the thermal gas contained in enclosure 1112. The movement of the gas over the LED assembly 1130 moves the gas boundary layer on the components of the LED assembly.

Because the heat sink structure 1149 transfers heat from the LED assembly to the gas in the enclosure 1114 the heat sink structure is completely contained in the sealed enclosure such that the primary thermal path from the LED assembly 1136 is through the fins 1149, the gas and the enclosure 1112. As a result, a heat sink structure is not physically connected to the base 1102 as shown in the embodiment of FIG. 1. As a result the enclosure 1112 may extend at least partially into the interior of the base 1102. With this arrangement the enclosure 1112 may be disposed adjacent the light transmissive portion 2 of the base 1103 such that the light transmissive portion 2 of the base 1103 is illuminated by the light in the enclosure 1112. The light transmissive portion 2 may be formed by any of the techniques described herein. The lamp embodiment of FIGS. 12 and 13 may also use any of the mechanisms described with respect to FIG. 1 through FIG. 11 for delivering light to the optically transmissive portion 2.

Figure 14:
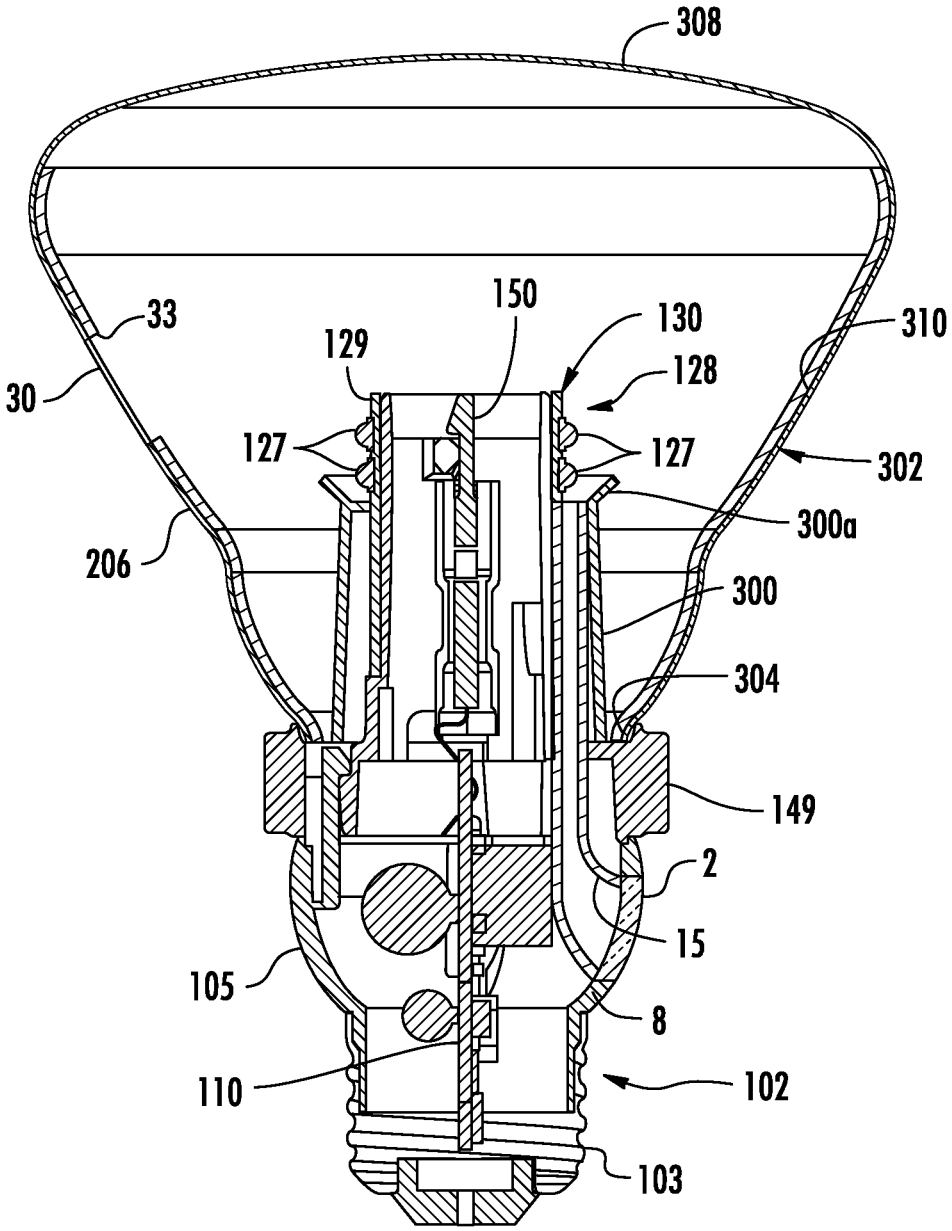
FIGS. 14 and 15 are section views of an alternate embodiment of a lamp of the invention.

Another embodiment of a lamp is shown in FIG. 14 where the lamp is a directional lamp such as a PAR or BR style lamp rather than the omnidirectional lamp of FIGS. 1 through 13. The enclosure 302 may be secured to the heat sink 149 as previously described or by using other connection mechanisms. The enclosure 302 comprises a housing 306 that is made of a transparent material and is typically coated on an interior surface with a highly reflective material such as aluminum to create a reflective surface 310 and an exit surface 308 through which the light exits the lamp. The exit surface 308 may be frosted or otherwise treated with a light diffuser material.

Figure 15:
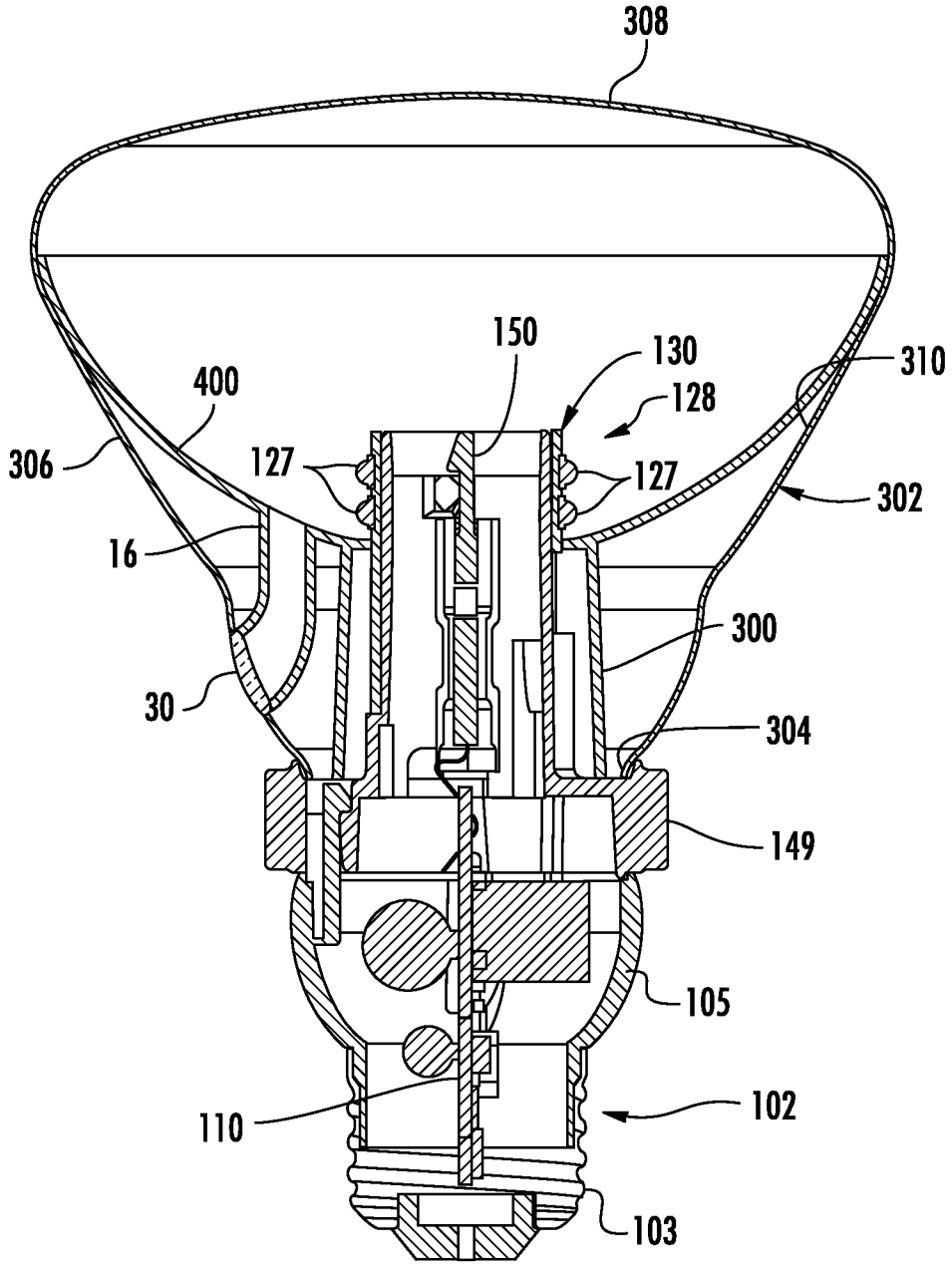

A reflector 300 may be positioned such that it reflects some of the light generated by the LED assembly 130. However, at least a portion of the light generated by the LED assembly 130 may not be reflected by the reflector 300. At least some of this light may be reflected by the reflective surface 310 of the enclosure 302. Some of the light generated by the LED assembly 130 may also be projected directly out of the exit surface 308 without being reflected by the primary reflector 300 or the reflective surface 310. FIGS. 14 and 15 show an embodiment of a directional lamp that uses the LED assembly 130, heat sink with the tower arrangement 149 and electrical interconnect 150 as previously described. In a PAR or BR type lamp the light is emitted in a directional pattern. Standard PAR bulbs are reflector bulbs that reflect light in a direction where the beam angle is tightly controlled using a parabolic reflector. PAR lamps may direct the light in a pattern having a tightly controlled beam angle such as, but not limited to, 10°, 25° and 40°. BR lamps have a directional light pattern where the beam angle is generally speaking less tightly controlled than in a PAR lamp. The bulb shown in FIGS. 14 and 15 may be used as a solid state replacement for a PAR or BR bulb. Where the lamp is intended to be used as a replacement for a PAR type lamp, the reflector 400 may reflect the light in a tightly controlled beam angle. The reflector 300 may comprise a parabolic surface **300*a* such that light reflecting off of the reflector 400** is reflected generally along the axis of the lamp to create a beam with a controlled beam angle. For a BR lamp the reflector may have a variety of configurations.

The directional lamp comprises a light non-transmissive base 102 comprising an Edison connector 103 and a housing 105 that may include a light transmissive portion 2 and a light non-transmissive portion 8 such as described with respect to the embodiments of FIGS. 1 through 13. The light may be delivered to the optically transmissive portion 2 using any of the techniques described herein. In the exemplary embodiment shown in FIG. 14, a light guide 15 extends from the LED assembly 128 to the optically transmissive portion 2.

Moreover, the directional lamp may include an light non-transmissive portion of the enclosure 302. Typically the housing 306 comprises a reflective surface or coating 310 that reflects light in the desired directional pattern. A light transmissive portion 30 may be formed in the enclosure 302 in addition to or in place of the light transmissive portion 2 formed on the base 102. Because the enclosure 302 is used to reflect light from LED assembly 128 a separate mechanism may not be required to deliver light to the light transmissive portion 30 such that the light transmissive portion 30 is illuminated by the light in enclosure 302. Because the reflective surface 310 may be provided by a coating, the light transmissive portion 30 may be formed by eliminating the coating where the light transmissive portion is desired such that a gap 33 is created in the coating 310 to expose the transparent material of the enclosure 306. The light transmissive portion 30 may be masked during the coating process to expose the underlying transparent material. In other embodiments the light transmissive portion 30 may be formed as previously described with reference to FIGS. 1-14.

Some directional lights may use an outer housing 302 and an internal reflector 400 where the internal reflector covers most or all of the enclosure except for the exit surface 308 as shown in FIG. 15. In some embodiments the internal reflector 400 may prevent light from reaching the exterior housing 302. In such an embodiment a light guide 16 may be used between the reflector 400 and the outer housing 306 such that light is delivered to the light transmissive portion 30. The light guide 16 and light transmissive portion 30 may be provided using the techniques previously described herein. Moreover, the lamp of FIG. 15 may include a light transmissive portion 2 as shown in FIG. 14.

Figure 16:
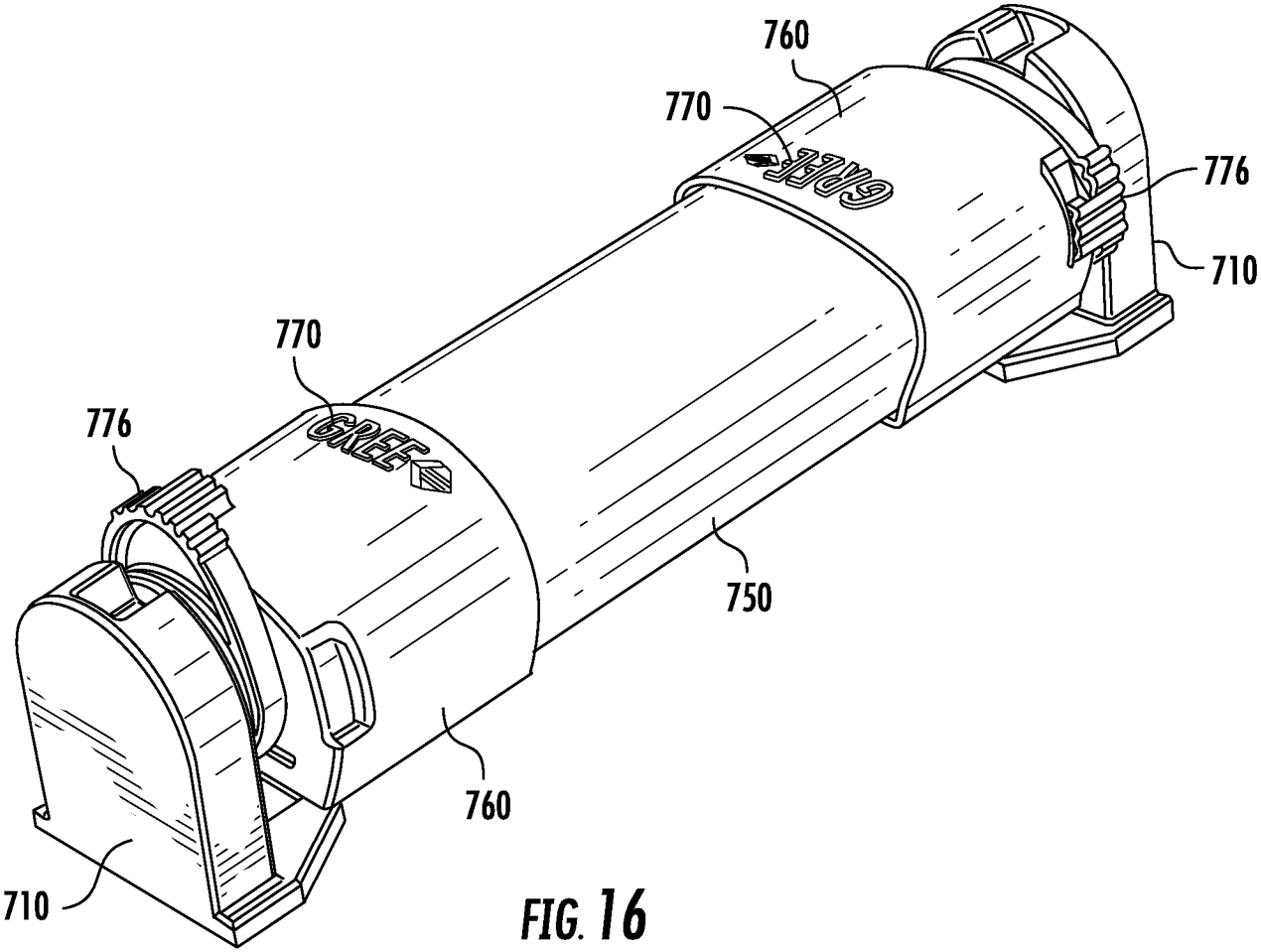
FIG. 16 is a perspective view of another alternate embodiment of a lamp of the invention.
Figure 17:
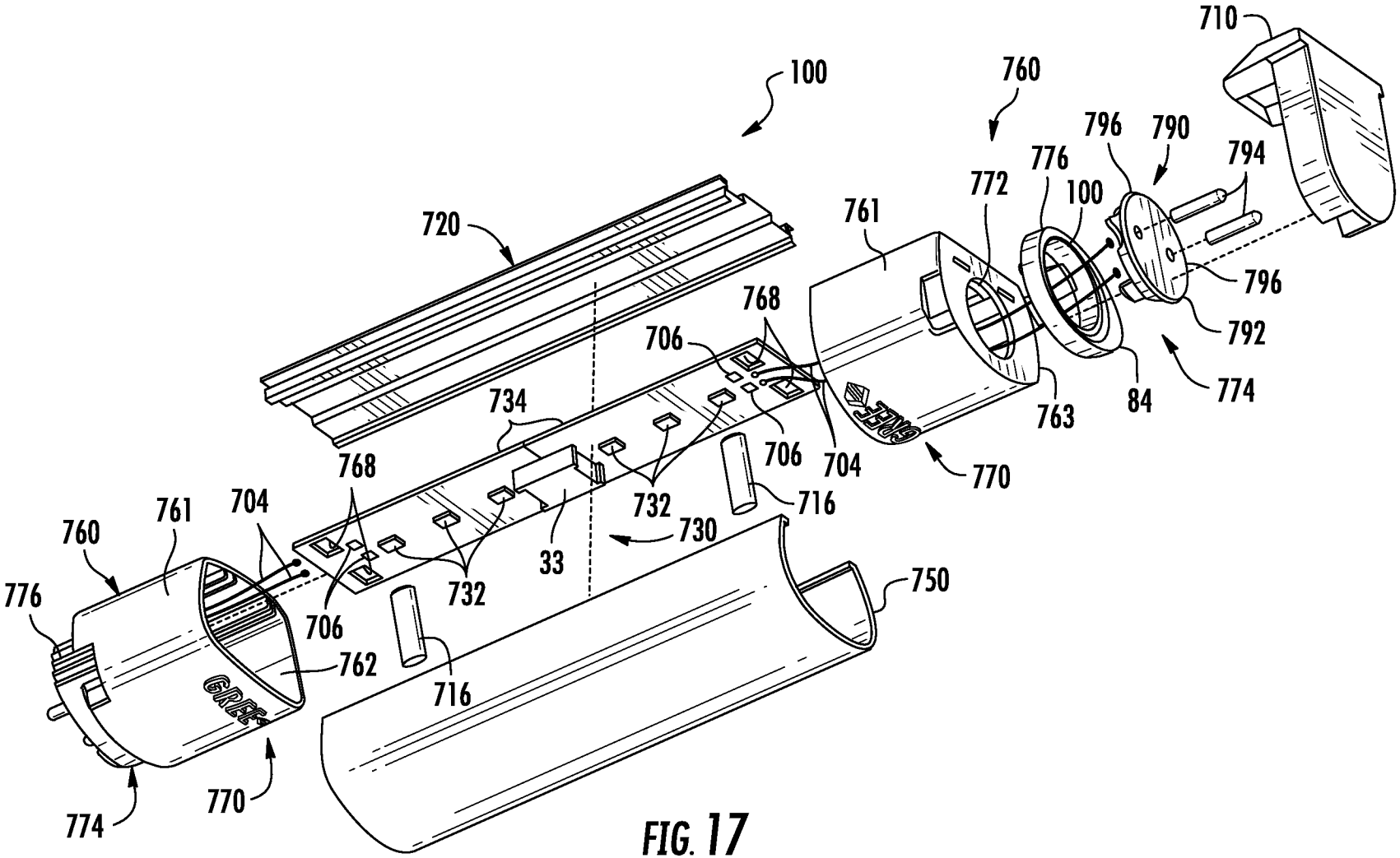
FIG. 17 is an exploded view of the lamp of FIG. 16.

Another embodiment of a lamp is shown in FIGS. 16 and 17. In one embodiment the LED lamp 700 comprises a generally planar or flat base 720. The base 720 may be made of a thermally conductive material such that it functions as a heat sink to dissipate heat from the LED assembly. The base 720 may be made of a rigid, thermally conductive material to support the LED assembly 730 and lens. The LED assembly 730 may comprise a plurality of LEDs or LED packages 732 mounted on board 734 that extend the length of, or substantially the length of, the base 720 to create a desired light pattern. The LEDs 732 may be arranged such that the light pattern extends the length of, or for a substantial portion of the length of, the lamp and is similar in length to a traditional fluorescent bulb. The LEDs 732 may be mounted on LED board 734 that provides physical support for the LEDs 732 and provides an electrical path for providing electrical power to the LEDs. The electrical path provides power to the LEDs and may comprise the power source, board 734 and intervening lamp electronics. The board 734 may comprise MCPCB, FR4, a flex circuit, lead frame or other suitable mounting substrate for the LEDs. The board may comprise the electrical components that form part of the electrical path to the LEDs or electrical conductors may comprise separate elements that are supported by the board. In the illustrated embodiments the base 720 and the LED board 734 are shown as separate physical elements; however, the LED board 734 and the base 720 may be a single element where the LED board has the structural integrity to support the lamp components.

A lens 750 may be connected to the base 720 to cover the LED assembly 730 and create a mixing chamber for the light emitted from the LEDs 732. The light is mixed in the chamber and the lens 750 diffuses the light to provide a uniform, diffuse, color mixed light pattern. The lens 750 may be made of molded plastic or other material and may be provided with a light diffusing layer. The light diffusing layer may be provided by etching, application of a coating or film, by the translucent or semitransparent material of the lens, by forming an irregular surface pattern during formation of the lens or by other methods.

End caps 760 may be provided at the opposite ends of the lens 750 to close the interior mixing chamber of LED lamp 700 and to support the electrical connectors 794 for connecting to the tombstone connectors 710 of the housing. The end caps 760, base 720/board 730 and lens 750 together define an enclosure that retains the LEDs 32. The enclosure is optically transmissive through the lens 750.

End caps 760 are identical such that the structure and operation of one end cap will be described. The end cap 760 comprises an internal chamber 762 defined by an opaque side wall 761 and an end wall 763 dimensioned and shaped to closely receive the base 720, LED board 734 and lens 750. In one embodiment the lens 750, LED board 734, and base 720 are slid into the chamber 762 and a snap-fit connection is used to secure the end caps 760 these components. In one embodiment the end cap 760 is provided with two deformable locking members that engage the LED board 734 when the LED board 734 is inserted onto the end cap 760. The locking members may be made of resilient material and have a first end connected to the end cap 760 and an engagement member at the free end that engage apertures 768 formed on the LED board 734.

The end wall 763 defines an aperture 772 for receiving the electrical connector 774 of the lamp. The electrical connector 774 comprises a rotating control member 776 that is fixed in the aperture 772 such that the control member 776 may rotate relative to the end cap 760 but is otherwise fixed to the end cap. The control member 776 rotates a plate 790 that carries a pair of pins 794. The plate 790 is mounted for rotation with the control member 776 such that rotation of the control member 776 rotates plate 792. The pins 794 are mounted in apertures 796 in the plate 790 and are positioned and dimensioned such that the pins 794 on opposite ends of the lamp 700 are able to engage the tombstone connectors 710 of a traditional fluorescent fixture. The pins 794 are connected to the LEDs by electrical conductors such as wires 704 that connect to electrical contacts such as pads 706 of the board 734.

A light transmissive portion 770 is formed on the light non-transmissive end caps 760 as previously described. The light transmissive portion may comprise a thin walled portion of the end cap, a separate lens, an insert molded lens or open aperture as previously described. Because the ends caps 760 form part of the enclosure for the mixing chamber of the light from the LEDs 732, the light transmissive portion 770 may be illuminated without using a light guide. However, in some embodiments a separate light guide 716 may be used for delivering light from selected ones of the LEDs 732 to the light transmissive portion 770.

With respect to the features described above with various example embodiments of a lamp, the features can be combined in various ways. For example, the various methods transmitting the light to the light transmissive portion may combined with any of the techniques for creating the light transmissive portion. Further, the lamp may comprise any of the embodiments described herein or any other embodiment of a lamp and the various methods of transmitting the light to the light transmissive portions and any of the methods for creating the light transmissive portions in the lamp may be used in any embodiment of an LED lamp that comprises a light non-transmissive portion. The embodiments of the lamps shown herein are examples only, illustrative of various designs for a lamp with a light transmissive portion; however, the lamp may have any configuration.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure being at least partially optically transmissive;

a light non-transmissive base connected to the enclosure comprising an electrical connector configured to electrically couple the lamp to an external power source;

at least one LED located in the enclosure and operable to emit light when energized through an electrical path from the electrical connector;

a light transmissive portion formed in the light non-transmissive base and spaced from the enclosure by a portion of the light non-transmissive base where the light transmissive portion is illuminated when the at least one LED is energized, the light transmissive portion being disposed in the base;

wherein the base comprises a housing defining an aperture, the light transmissive portion comprises a lens mounted to the housing and covering the aperture, the lens comprising at least one of a transparent, semi-transparent or translucent material.

2. The lamp of claim 1 wherein the light transmissive portion comprises indicia used to convey information where light emitted through the light transmissive portion is not used for illumination purposes.

3. The lamp of claim 2 wherein the indicia comprises branding information.

4. The lamp of claim 1 wherein the lens is insert molded in the light non-transmissive portion.

5. The lamp of claim 1 wherein light from the at least one LED illuminates the light transmissive portion.

6. The lamp of claim 1 wherein an additional LED separate from the at least one LED illuminates the light transmissive portion, where the additional LED does not emit light through the enclosure.

7. The lamp of claim 1 wherein an additional LED is positioned in the enclosure adjacent the light transmissive portion.

8. The lamp of claim 6 wherein the additional LED is positioned in the housing.

9. The lamp of claim 6 wherein a light guide transmits light from the additional LED to the light transmissive portion.

10. The lamp of claim 1 wherein a light guide transmits light from the at least one LED to the light transmissive portion.

11. The lamp of claim 1 wherein a light guide extends from the enclosure into the base.

12. The lamp of claim 11 wherein the light guide extends through a heat sink.

13. The lamp of claim 1 further comprising a reflector for reflecting light toward the light transmissive portion.

14. A lamp comprising:

an enclosure comprising a first light transmissive portion;

a base secured to the enclosure, the base comprising an electrical connector configured to electrically couple the lamp to an external power source;

a heat sink disposed between the enclosure and the base;

at least one LED located in the enclosure and operable to emit light from the enclosure for illumination when energized through an electrical path from the electrical connector;

a second light transmissive portion in the base bounded by a light non-transmissive portion that is illuminated separate from and physically spaced from the first light transmissive portion of the enclosure when the at least one LED is energized wherein a light guide transmits light from the at least one LED to the light transmissive portion.

15. The lamp of claim 14 wherein the enclosure comprises a first portion having a first wall thickness and a second portion having a second wall thickness, the first wall thickness being less than the second wall thickness and defining a thin walled section that comprises the light transmissive portion and the second wall thickness defining the light non-transmissive portion where light is transmitted through the thin walled section.

16. The lamp of claim 14 wherein the base comprises a housing defining an aperture, the light transmissive portion comprises a lens mounted to the housing and covering the aperture.

17. The lamp of claim 16 wherein the lens comprises at least one of a transparent, semi-transparent or translucent material.

18. The lamp of claim 14 wherein the light transmissive portion comprises an aperture extending through the base.

19. A lamp comprising:

an enclosure being at least partially optically transmissive;

a light non-transmissive base connected to the enclosure comprising an electrical connector configured to electrically couple the lamp to an external power source;

at least one LED located in the enclosure and operable to emit light when energized through an electrical path from the electrical connector;

a light transmissive portion formed in the light non-transmissive base and spaced from the enclosure by a portion of the light non-transmissive base where the light transmissive portion is illuminated when the at least one LED is energized, the light transmissive portion being disposed in the base;

a reflector for reflecting light toward the light transmissive portion.

20. The lamp of claim 19 wherein the base comprises a first portion having a first wall thickness and a second portion having a second wall thickness, the first wall thickness being less than the second wall thickness and defining a thin walled section that comprises the light transmissive portion where light is transmitted through the thin walled section.

21. The lamp of claim 19 wherein the base comprises a housing defining an aperture, the light transmissive portion comprises a lens mounted to the housing and covering the aperture.

* * * * *